United States Patent [19]

Friese et al.

[11] Patent Number: 4,527,992

[45] Date of Patent: Jul. 9, 1985

[54] PROCESS FOR THE PRODUCTION OF WATERPROOF LEATHERS AND SKINS

[75] Inventors: Hans-Herbert Friese; Wolfgang Prinz, both of Monheim, Fed. Rep. of Germany

[73] Assignee: Henkel Kommanditgesellschaft auf Aktien, Duesseldorf, Fed. Rep. of Germany

[21] Appl. No.: 530,244

[22] Filed: Sep. 8, 1983

[30] Foreign Application Priority Data

Feb. 8, 1983 [DE] Fed. Rep. of Germany ..... 3304120

[51] Int. Cl.[3] ..... C14C 9/02; C14C 9/00; C14C 11/00

[52] U.S. Cl. ..... 8/94.21; 8/94.22; 8/94.23; 252/8.57

[58] Field of Search ..... 252/8.57; 8/94.22, 94.23, 8/94.21; 427/389

[56] References Cited

U.S. PATENT DOCUMENTS

| | | | |
|---|---|---|---|
| 2,061,618 | 11/1936 | Downing et al. | 252/8.57 |
| 2,118,308 | 5/1938 | Jaeger | 252/8.57 |
| 2,630,408 | 3/1953 | Lighthipe et al. | 252/8.57 |
| 3,765,833 | 10/1973 | Plapper et al. | 252/8.57 |
| 4,314,800 | 2/1982 | Monsheimer et al. | 8/94.18 |
| 4,398,911 | 8/1983 | May et al. | 8/436 |

FOREIGN PATENT DOCUMENTS 30028 2/1955 Fed. Rep. of Germany .

*Primary Examiner*—Maria Parrish Tungol
*Attorney, Agent, or Firm*—Ernest G. Szoke; Nelson Littell, Jr.

[57] ABSTRACT

This invention relates to a process for producing waterproof leathers and skins by tanning, retanning, dyeing, stuffing, and fixing which is characterized in that, after tanning and, optionally, dyeing, stuffing agents (A) in the form of oxidized or oxidized and partly sulfonated long-chain hydrocarbons of waxes and impregnating agents (B) in the form of copolymers or from 60 to 95 mol percent of (meth) acrylic acid and from 5 to 40 mol percent of an ester, amide or nitrile of (meth) acrylic acid having a molecular weight of from 800 to 10,000 in salt form are successively used in the same bath, followed by acidification, fixing and finishing. The co-use of the impregnating agents (B) with the particular stuffing agents (A) results in much greater degree of resistance to water penetration than that obtained by the use of the stuffing agent (A), alone.

15 Claims, No Drawings

PROCESS FOR THE PRODUCTION OF WATERPROOF LEATHERS AND SKINS

BACKGROUND OF THE INVENTION

This invention relates to improved method of producing waterproof leathers and skins.

There are in particular three methods for producing waterproof leathers and skins, namely:

(1) impregnating through the incorporation of water-insoluble substances, for example solid fats, waxes or special polymers.

(2) impregnation through the incorporation of substances which swell in water and which, on taking up water, form highly viscous emulsions, blocking the interstices between the leather fibers, for example special emulsifiers of the the W/O-type.

(3) treatment with hydrophobizing substances, for example aluminum and chromium complexes, silicones or organic fluoro-compounds.

A combination of methods (2) and (3) has been successfully applied in practice preferably being carried out in an aqueous liquor in a tumbler. The W/O emulsifiers are converted into hydrophobizing metal complex salts by fixing with chromium or aluminum salts after stuffing. Unfortunately, this process is attended by disadvantages insofar as the stuffing requires relatively high pH-values (above 6) to avoid surface accumulation of the fats and, hence, smearing. However, this easily leads to a certain looseness of grain of the leather. In addition, the penetrometer values obtained in practice frequently show very considerable fluctuations so that the leather may have to be aftertreated by casting, spraying or oozing.

In addition, German Published Patent Application No. F 10 300.28a, 9 describes a process for improving the properties of leather, particularly in regard to its uptake of and permeability to water, which is characterized in that aqueous solutions or emulsions of salts of carboxyl-group-containing polymers are introduced into the material, optionally in the presence of stuffing and thickening agents and/or buffer substances, and the material is optionally subjected to an aftertreatment to render the polymers insoluble. The carboxyl-containing polymers mentioned include inter alia copolymers of acrylic acid or methacrylic acid and esters thereof, the content of carboxyl-containing components varying between 2.5% and 50%. However, it was found that very large quantities of polymers (>30%, based on the shaved weight of the leather) have to be incorporated to obtain as adequate impregnating effect.

OBJECTS OF THE INVENTION

An object of the present invention is to develop a method for the production of waterproof leathers and skins which avoids the drawbacks of the prior art.

Another object of the present invention is the development of an improvement in the process for the production of waterproof leathers and skins by the steps of tanning, optionally retanning, optionally dyeing, stuffing and impregnating using copolymers containing carboxyl groups, and fixing, the improvement consisting essentially of, after tanning and, optionally dyeing, the leather and skins, treating the leather and skins successively in the same bath first with stuffing agents (A) selected from the group consisting of oxidized $C_{18}$–$C_{26}$ aliphatic hydrocarbons, oxidized and partially sulfonated $C_{18}$–$C_{26}$ aliphatic hydrocarbons, oxidized $C_{32}$–$C_{40}$ waxes and oxidized and partially sulfonated $C_{32}$–$C_{40}$ waxes and second with impregnating agents (B) in the form of salts selected from the group consisting of the alkali metal, ammonium and lower alkylamine, of a copolymer of from 60 to 95 mol percent of an unsaturated acid selected from the group consisting of acrylic acid and methacrylic acid and 5 to 40 mol percent of a monomer selected from the groups consisting of methyl acrylate, ethyl acrylate, propyl acrylate, acrylamide, acrylonitrile, methyl methacrylate, ethyl methacrylate, methacrylamide and methacrylonitrile said copolymer having a molecular weight of from 800 to 10,000, followed by acidification, as said stuffing and impregnating using copolymers containing carboxyl groups step.

These and other objects of the invention will become more apparent as the description thereof proceeds.

DESCRIPTION OF THE INVENTION

The present invention relates to a process for the production of waterproof leathers and skins by tanning, retanning dyeing, stuffing and impregnating, using copolymers containing carboxyl groups, and fixing and finishing which is charaterized in that, after tanning and, optionally, dyeing, stuffing agents (A) in the form of oxidized or oxidized and partly sulfonated long-chain $C_{18}$–$C_{26}$ hydrocarbons or $C_{32}$–$C_{40}$ waxes and impregnating agents (B) in the form of copolymers of from 60 to 95 mol percent of acrylic acid and/or methacrylic acid and from 5 to 40 mol percent of the methyl, ethyl, propyl or butyl ester, amide or nitrile of acrylic acid or methacrylic acid, said copolymer having a molecular weight of from 800 to 10,000, in the form of the alkali metal, ammonium or amine salts, are successively used in the same bath, followed by acidification, fixing and finishing.

More particularly, the present invention relates to an improvement in the process for the production of waterproof leathers and skins by the steps of tanning, optionally retanning, optionally dyeing, stuffing and impregnating using copolymers containing carboxyl groups, and fixing, the improvement consisting essentially of, after tanning and optionally dyeing, the leather and skins, treating the leather and skins successively in the same bath first with stuffing agents (A) selected from the group consisting of oxidized $C_{18}$–$C_{26}$ aliphatic hydrocarbons, oxidized and partially sulfonated $C_{18}$–$C_{26}$ aliphatic hydrocarbons, oxidized $C_{32}$–$C_{40}$ waxes and oxidized and partially sulfonated $C_{32}$–$C_{40}$ waxes and second with impreganting agents (B) in the form of salts selected from the group consisting of the alkali metal, ammonium and lower alkylamine, of a copolymer of from 60 to 95 mol percent of an unsaturated acid selected from the group consisting of acrylic acid and methacrylic acid and 5 to 40 mol percent of a monomer selected from the gorups consisting of methyl acrylate, ethyl acrylate, propyl acrylate, acrylamide, acrylonitrile, methyl methacrylate, ethyl methacrylate, methacrylamide and methacrylonitrile said copolymer having a molecular weight of from 800 to 10,000, followed by acidification, as said stuffing and impregnating using copolymers containing carboxyl groups step.

In practice, the process starts out with rawhides or skins which are tanned, and optionally retanned in the usual way using inorganic and/or, natural or synthetic tanning materials, such as chromium or aluminum salts, or phenol/naphthalene condensates, or vegetable tanning materials.

On completion of retanning and thorough rinsing, the hides or skins are optionally dyed and then stuffed. According to the invention, oxidized or oxidized and partly sulfonated long-chain $C_{18}$–$C_{26}$-hydrocarbons or $C_{32}$–$C_{40}$ waxes are used as stuffing agents (A) in a quantity of from 3% to 8% by weight, based on the shaved weight of the leather. The stuffing agents have acid numbers of from 5 to 100 and, if partially sulfonated, $SO_3$-contents of from 0.2% to 2.0% by weight. Examples of particularly suitable stuffing agents are sulfoxidized $C_{20}$–$C_{22}$ paraffin scale wax having an $SO_3$-content of from 0.2% to 0.5% by weight and an acid number of from 5 to 15, oxidized and partially sulfonated $C_{24}$–$C_{26}$ polyethylenes or paraffins having an $SO_3$-content of from 0.3% to 0.8% by weight and an acid number of from 5 to 20, and oxidized $C_{22}$–$C_{26}$ paraffin having an acid number of from 60 to 70. The products are preferably used in the form of their alkali metal, ammonium or amine salts. The amine salts are preferably the salts of lower alkylamines such as methylamine, dimethylamine, trimethylamine etc.

The stuffing agents are preferably used in combination with special W/O-emulsifiers, such as $C_{12}$–$C_{18}$-monoalkyl phosphoric acid esters, $C_{16}$–$C_{20}$-alkenyl-succinic acids, higher fatty alcohol monoesters, higher fatty acid monoethanolamide ether sulfates or higher fatty acids all in the form of the alkali metal, ammonium or lower alkylamine salts.

After about 45 to 60 minutes, the hides or skins are further treated in the same bath for 30 minutes at a pH-value of from 5 to 6 with the addition of the copolymer (B). Preferred copolymers are copolymers of from 70 to 85 mol percent of acrylic acid and/or methacrylic acid with from 15 to 30 mol percent of the methyl, ethyl, propyl, or butyl ester or amide or nitrile of acrylic acid or methacrylic acid, in the form of the alkali metal, ammonium or lower alkylamine salts. The molecular weight of the copolymers is in the range from 800 to 10,000. The copolymers are used in a quantity of from 0.5% to 3% by weight, based on the shaved weight of the leather. Examples of suitable copolymers are products based on 75 mol percent of acrylic acid, and 25 mol percent to ethyl acrylate, Na-salt, 85 mol percent of acrylic acid and 15 mol percent of acrylonitrile, ammonium salt, and 70 mol percent of acrylic acid and 30 mol percent of acrylamide, Na-salt.

After this treatment, the hides or skins are re-acidified, for example with formic acid or acetic acid, fixed by the addition of from 2 to 4% by weight of a chromium and/or aluminum tanning material and finished in the usual way. Soft leathers or skins having good grain stability are obtained. Resistance to water (penetration and uptake of water) is considerably improved. The results obtained are remarkably uniform and reproducible.

EXAMPLES

The following examples are illustrative of the invention without being limitative in any manner.

EXAMPLE 1

Cowhides limed, delimed, drenched and pickled in the usual way, but in the absence of emulsifiers, were chrome-tanned and shaved to about 2.8 mm. After washing with 200% of water at 25° C., the hides were neutralized against bromcresol green. Retanning was carried out with 3% by weight of and auxiliary tanning material based on a phenol/naphthalene condensate.

6% by weight of mimosa,
6% by weight of quebracho,
6% by weight of chestnut, until the leather was tanned throughout its cross-section. After thorough rinsing, the leathers were treated with 3% by weight of a 25% basic aluminum tanning material.

Dyeing and stuffing were carried out as follows:

| | |
|---|---|
| 100% by weight of water at 65° C. | 15 minutes |
| 1% by weight of acid dye | |
| 6.4% by weight of sulfoxidized paraffin scale wax, $C_{20}$–$C_{22}$, 0.2% to 0.5% by weight of $SO_3$ acid number 5–15, ammonium salt | 60 minutes |
| 2% by weight of ammonia, 25%. (pH of the liquor 5.8) | |
| 2% by weight of a copolymer of 80 mol percent of acrylic acid and 20 mol percent of ethyl acrylate, Na—salt | 30 minutes |
| 2.5% by weight of formic acid | 30 minutes |
| 2% by weight of chrome tanning material, 33%, basic | 30 minutes |
| 2% by weight of aluminum tanning material, 25% basic. | 30 minutes |

All the percentages quoted are based on the shaved weight of the leather.

the leathers obtained after rinsing and finishing in the usual way are soft and are characterized by a distinct delay in the penetration of water and by their minimal uptake of water (sample A).

A corresponding comparative test without utilizing copolymer (sample B) produced considerably less favorable results in regard to resistance to water.

| | Sample A | Sample B |
|---|---|---|
| Penetration of water | | |
| Penetrometer 7.5% compression | >24 h | 90 mins. |
| Water uptake, dynamic | | |
| after 1 hour | 6.5% | 11.5% |
| after 2 hour | — | 47.6% |
| after 24 hour | 36.3% | — |

EXAMPLE 2

Cowhides (for upper leather) were treated in the same way as in Example 1, except that stuffing was carried out with 5% by weight of sulfoxidized paraffin scale wax, $C_{20}$–$C_{22}$, 0.2% to 0.5% by weight of $SO_3$, acid number 5–15, ammonium salt, 1.4% by weight of $C_{12}$–$C_{18}$-monoalkyl phosphoric acid ester, Na-salt.

Followed by copolymer treatment, etc., as in Example 1.

The leathers obtained after finishing were soft and again showed better behavior with respect to water in Sample A than in sample B (without copolymer treatment).

| | Sample A | Sample B |
|---|---|---|
| Penetration of water | | |
| Penetrometer | >24 h | 225 mins. |

-continued

| | Sample A | Sample B |
|---|---|---|
| Compression 7.5% | | |
| Water uptake, dynamic | | |
| after 3 hour | 12.4% | 16.5% |
| after 6 hour | 16.2% | 44.1% |
| after 24 hour | 30.4% | — |

EXAMPLE 3

Cowhides (for upper leather) were treated in the same way as in Example 1, except that stuffing was carried out with

| |
|---|
| 6.4% by weight of a mixture of<br>oxidized and sulfonated $C_{24}$-$C_{26}$-paraffin,<br>0.3% to 0.8% by weight of $SO_3$, acid number<br>5-20, ammonium salt<br>$C_{12}$-$C_{18}$-monoalkyl phosphoric acid ester,<br>Na—salt,<br>$C_{16}$-$C_{18}$-alkenyl succinic acid, ammonium salt,<br>in a ratio by weight of 6.2:2.8:1.3. |

Followed by the copolymer treatment etc., as in Example 1. The leathers obtained after finishing were soft and, in Sample A, showed outstanding behavior with respect to water. Sample B was prepared as Sample A but without the copolymer treatment.

| | Sample A | Sample B |
|---|---|---|
| Penetration of water | | |
| Penetrometer | >24 h | 190 mins. |
| Compression 7.5% | | |
| Water uptake, dynamic | | |
| after 3 hour | 9.8% | 17.2% |
| after 6 hour | 12.2% | — |

EXAMPLE 4

Cowhides (for upper leather) were treated in the same way as in Example 1, except that stuffing was carried out with

| |
|---|
| 6.4% by weight of a mixture of<br>oxidized $C_{22}$-$C_{26}$-paraffin,<br>acid number 60-70<br>$C_{12}$-$C_{18}$-monoalkyl phosphoric acid ester,<br>Na—salt,<br>$C_{16}$-$C_{18}$-fatty acid monoethanolamide<br>EO-sulfate, ammonium salt,<br>in a ratio of 4.5:1.5:0.4. |

Followed by the copolymer treatment etc., as in Example 1. The leathers obtained after finishing were soft and in Sample A, showed favorable behavior with respect to water as compared with Sample B (without copolymer treatment).

| Penetration of water | Sample A | Sample B |
|---|---|---|
| Penetrometer | >6 h | 150 mins. |
| Compression 7.5% | | |

The preceding specific embodiments are illustrative of the practice of the invention. It is to be understood however, that other expedients known to those skilled in the art or disclosed herein, may be employed without departing from the spirit of the invention or the scope of the appended claims.

We claim:

1. In the process for the production of waterproof leathers and skins by the steps of tanning, or tanning and retanning, or tanning and dyeing, stuffing and impregnating using copolymers containing carboxyl groups, and fixing, the improvement consisting essentially of, after tanning or after tanning and dyeing the leather and skins, treating said leathers and skins successively in the same bath first with from 3% to 8% by weight, based on the weight of said leathers and skins of stuffing agents (A) having acid numbers of from 5 to 100 and selected from the group consisting of oxidized $C_{18}$-$C_{26}$ aliphatic hydrocarbons, oxidized and partially sulfonated $C_{18}$-$C_{26}$ aliphatic hydrocarbons, oxidized $C_{32}$-$C_{40}$ waxes and oxidized and partially sulfonated $C_{32}$-$C_{40}$ waxes and second with from 0.5% to 3% by weight, based on the weight of said leathers and skins of impregnating agents (B) in the form of salt selected from the group consisting of the alkali metal, ammonium and lower alkylamine of a copolymer of from 60 to 95 mol percent of an unsaturated acid selected from the group consisting of acrylic acid and methacrylic acid and from 5 to 40 mol percent of monomer selected from the group consisting of methyl acrylate, ethyl acrylate, propyl acrylate, butyl acrylate, acrylamide, acrylonitrile, methyl methacrylate, ethyl methacrylate, propyl methacrylate, butyl methacrylate, methacrylamide and methacrylonitrile, said copolymer having a molecular weight of from 800 to 10,000, followed by acidification, as said stuffing and impregnating steps.

2. The process of claim 1 wherein said stuffing agents (A) are said oxidized $C_{18}$-$C_{26}$ aliphatic hydrocarbons and oxidized $C_{32}$-$C_{40}$ waxes, having acid numbers of from 5 to 100, in the form of salts selected from the group consisting of alkali metal, ammonium and lower alkylamine.

3. The process of claim 2 wherein said stuffing agents (A) are employed in combination with W/O emulsifiers selected from the group of $C_{12}$-$C_{18}$ monoalkyl phosphoric acid esters, $C_{16}$-$C_{20}$ alkenylsuccinic acid, higher fatty acid sarcosides and citric acid higher fatty alcohol monoesters, in the form of salts selected from the group consisting of alkali metal, ammonium and lower alkylamine.

4. The process of claim 3 wherein the W/O emulsifiers are employed in combination of emulsifiers selected from group consisting of higher fatty acid monoethanolamide ether sulfates and higher fatty acids, in the form of salts selected from the group consisting of alkali metal, ammonium and lower alkylamine.

5. The process of claim 1 wherein said stuffing agents (A) are said oxidized and partially sulfonated $C_{18}$-$C_{26}$ aliphatic hydrocarbons and $C_{32}$-$C_{40}$ waxes, having acid numbers of from 5 to 100 and $SO_3$-contents of from 0.2% to 2.0% by weight, in the form of salts selected from the group consisting of alkali metal, ammonium and lower alkylamine.

6. The process of claim 5 wherein said stuffing agent (A) is sulfoxidized $C_{20}$-$C_{22}$ paraffin scale wax having an $SO_3$ content of 0.2% to 0.5% by weight and an acid number of from 5 to 15, in the form of salts selected from the group consisting of alkali metal, ammonium and lower alkylamine.

7. The process of claim 5 wherein said stuffing agent (A) is oxidized and sulfonated $C_{24}$-$C_{26}$ polyethylenes or paraffins having an $SO_3$ content of from 0.3% to 0.8% by weight and an acid number of from 5 to 20, in the form salts selected from the group consisting of alkali metal, ammonium and lower alklamine.

8. The process of claim 5 wherein said stuffing agent (A) is oxidized $C_{22}$–$C_{26}$ paraffin having an acid number of from 60 to 70, in the form of salts selected from the group consisting of alkali metal, ammonium and lower alkylamine.

9. The process of claim 5 wherein said stuffing agents (A) are employed in combination with W/O emulsifiers selected from the group consisting of $C_{12}$–$C_{18}$ monolkyl phosphoric acid esters, $C_{16}$–$C_{20}$ alkenylsuccinic acid, higher fatty acid sarcosides and citric acid higher fatty alcohol monoesters, in the form of salts selected from the group consisting of alkali metal, ammonium and lower alkylamine.

10. The process of claim 9 wherein the W/O emulsifiers are employed in combination with emulsifiers selected from group consisting of higher fatty acid monoethanolamide ether sulfates and higher fatty acids, in the form of salts selected from the group consisting of alkali metal, ammonium and lower alkylamine.

11. The process of claim 1 wherein said stuffing agents (A) are employed in combination with W/O emulsifiers selected from the group consisting of $C_{12}$–$C_{18}$ monoalkyl phosphoric acid esters, $C_{16}$–$C_{20}$ alkenylsuccinic acid, higher fatty acid sarcosides and citric acid higher fatty alcohol monoesters, in the form of salts selected from the group consisting of alkali metal, ammonium and lower alkylamine.

12. The process of claim 11 wherein the W/O emulsifiers are employed in combination with emulsifiers selected from group consisting of higher fatty acid monoethanolamide ether sulfates and higher fatty acids, in the form of salts selected from the group consisting of alkali metal, ammonium and lower alkylamine.

13. The process of claim 1 wherein said impregnating agents (B) are said salts of copolymers of from 70 to 85 mol percent of said unsaturated acid and from 15 to 30 mol percent of said monomer.

14. The process of claim 13 wherein said impregnating agents (B) is the sodium salt of a copolymer of 75 mol percent of acrylic acid and 25 mol percent of ethyl acrylate or the sodium salt of a copolymer of 85 mol percent of acrylic acid and 15 mol percent of acrylamide.

15. The process of claim 1 wherein, after said stuffing, impregnation and acidification, the leather or skins are fixed with from 2% to 4% by weight, based on the weight of said leathers or skins, of a chromium of aluminum tanning material.

* * * * *